US011143172B2

(12) United States Patent
Rawlings et al.

(10) Patent No.: US 11,143,172 B2
(45) Date of Patent: Oct. 12, 2021

(54) PISTON/LINER CONFIGURATION COORDINATION IN A PISTON PUMP

(71) Applicant: FLUID METERING INC., Syosset, NY (US)

(72) Inventors: David Lionel Rawlings, Sound Beach, NY (US); Joseph Ervin Middleton, Hicksville, NY (US)

(73) Assignee: FLUID METERING, INC., Syosset, NY (US)

( * ) Notice: Subject to any disclaimer, the term of this patent is extended or adjusted under 35 U.S.C. 154(b) by 0 days.

(21) Appl. No.: 16/760,793

(22) PCT Filed: Nov. 1, 2018

(86) PCT No.: PCT/US2018/058690
§ 371 (c)(1),
(2) Date: Apr. 30, 2020

(87) PCT Pub. No.: WO2019/089912
PCT Pub. Date: May 9, 2019

(65) Prior Publication Data

US 2020/0325880 A1 Oct. 15, 2020

Related U.S. Application Data

(60) Provisional application No. 62/580,139, filed on Nov. 1, 2017.

(51) Int. Cl.
*F04B 7/06* (2006.01)
*F04B 7/04* (2006.01)
(Continued)

(52) U.S. Cl.
CPC ..... *F04B 7/06* (2013.01); *F04B 7/04* (2013.01); *F04B 9/02* (2013.01); *F04B 11/0091* (2013.01);
(Continued)

(58) Field of Classification Search
CPC .. F04B 7/06; F04B 13/00; F04B 53/14; F04B 53/166; F04B 7/04; F04B 11/0091
See application file for complete search history.

(56) References Cited

U.S. PATENT DOCUMENTS 3,168,872 A * 2/1965 Pinkerton ..... F04B 7/06 417/492
5,494,420 A * 2/1996 Mawhirt ..... F04B 7/06 417/499
(Continued)

FOREIGN PATENT DOCUMENTS

CN 201502493 U 6/2010

*Primary Examiner* — Peter J Bertheaud
(74) *Attorney, Agent, or Firm* — Hoffmann & Baron, LLP

(57) ABSTRACT

A liquid pump having a pump liner and a pump piston, wherein the pump liner defines a central longitudinal bore and a transverse inlet bore communicating with the central bore for conveying a liquid. The pump piston has a centerline intersecting with a centerline of the transverse inlet bore, and further has a flat surface formed parallel with the piston centerline at a distal end of the piston. The flat surface defines a cut-out portion of the piston, wherein the cut-out portion has a hydraulic diameter equal to the diameter of the transverse inlet bore of the liner, and a distance from the centerline of the piston to the flat surface defining the cut-out portion is greater than or equal to ½ of the diameter of the transverse inlet bore of the liner.

8 Claims, 5 Drawing Sheets

(51) Int. Cl.

| | |
|---|---|
| ***F04B 53/16*** | (2006.01) |
| ***F04B 53/14*** | (2006.01) |
| ***F04B 9/02*** | (2006.01) |
| ***F04B 13/00*** | (2006.01) |
| ***F04B 11/00*** | (2006.01) |

(52) U.S. Cl.
CPC ..... *F04B 13/00* (2013.01); *F04B 53/14* (2013.01); *F04B 53/166* (2013.01)

(56) References Cited

U.S. PATENT DOCUMENTS

| | | | | |
|---|---|---|---|---|
| 7,785,084 | B1 * | 8/2010 | Rawlings | F04B 53/06 417/500 |
| 7,798,783 | B2 * | 9/2010 | Burns | F04B 7/06 417/53 |
| 9,261,085 | B2 * | 2/2016 | Middleton | F04B 53/166 |
| 9,828,978 | B2 * | 11/2017 | Middleton | F04B 7/06 |

* cited by examiner

PISTON/LINER CONFIGURATION COORDINATION IN A PISTON PUMP

CROSS-REFERENCE TO RELATED APPLICATION

This application claims the benefit of U.S. Provisional Application No. 62/580,139, filed Nov. 1, 2017, which is incorporated herein by reference in its entirety for all purposes.

BACKGROUND OF THE INVENTION

The present invention relates generally to liquid pumping systems, wherein a fluid is moved from a supply vessel to a receiving vessel. More particularly, the present invention relates to the coordination of the diameter of the liner ports to the depth of the piston flat which together define the fluid flow channel within the pump.

There are situations in which it is necessary to obtain relatively high flow rates of the pumped fluid. High flow rates can typically be obtained through increases in pump speed, pump dimensions and pump stroke. Within the constraints of pump size, it has been found that increases in pump speed and/or stroke beyond a certain point do not result in higher fluid output. Accordingly, manufacturers of virtually all positive displacement pumps offer a variety of product sizes so that a wide range of flows can be provided. Occasionally, constraints of available space or other factors urge attempts to surpass the upper flow limits specified for a given pump.

Positive displacement pumps have been around for many years. These pumps include a specially designed piston/liner set, wherein a rotating and reciprocating piston has a cutout at the end of the piston in the shape of the letter "D". During the intake stroke, one port of the liner is open and fluid is sucked into the liner and travels down the "D" cut-out on the piston to fill the liner. Although careful consideration has been historically applied to the depth of the piston cutout, that consideration has been limited to making sure that, during piston rotation, there is no instance where both ports of the liner are open, which is commonly referred to as a blow-by condition.

Typically the port diameter of the liner has been arbitrarily chosen as a convenient fractional dimension which could be obtained with readily available tooling. Table A below shows typical liner port diameters for a variety of pump sizes according to the prior art.

TABLE A

| Nominal Piston Diameter (inch) | Liner Port Diameter (inch) |
|---|---|
| .125 (1/8) | .062 (1/16) |
| .187 (3/16) | .085 (≈3/32) |
| .250 (1/4) | .125 (1/8) |
| .375 (3/8) | .218 (7/32) |
| .5 (1/2) | .250 (1/4) |

As can be seen from Table A, once the port diameter has been selected, past practice has been, as mentioned above, to select the depth of the flat on the end of the piston to be as deep as possible without there having the blow-by danger of rotation position allowing even a slight portion of both ports to be exposed simultaneously. Such a condition would allow undesired fluid flow through the pump caused by pressure differential from inlet-to-outlet while both ports are open.

Accordingly, it would be desirable to design a pump with sizes for the piston diameter and depth of the flat that optimizes fluid flow without the danger of blow-by and flow cavitation.

SUMMARY OF THE INVENTION

In one aspect of the present disclosure, a liquid pump having a pump liner and a pump piston is provided. The pump liner defines a central longitudinal bore and a transverse inlet bore communicating with the central bore for conveying a liquid. The transverse inlet bore has a diameter centered around a centerline intersecting with a centerline of the central longitudinal bore. The pump piston is axially and rotatably slidable within the central longitudinal bore for pumping the liquid from the transverse inlet bore. The pump piston has a centerline intersecting with a centerline of the transverse inlet bore, and further has a flat surface formed parallel with the piston centerline at a distal end of the piston. The flat surface defines a cut-out portion of the piston, wherein the cut-out portion has a hydraulic diameter Dh defined as Dh=4 A/P, where A is a cross-sectional area of the cut-out portion and P is the perimeter of the cut-out portion. The hydraulic diameter of the cut-out portion is equal to the diameter of the transverse inlet bore of the liner and a distance from the centerline of the piston to the flat surface defining the cut-out portion is greater than or equal to ½ of the diameter of the transverse inlet bore of the liner.

The pump liner further preferably includes a transverse outlet bore, wherein the cut-out portion of the piston rotationally reciprocates between the inlet bore and the outlet bore. The cut-out portion preferably has a D-shaped cross-section and further preferably presents a flow resistance equal to a flow resistance presented by the inlet bore.

In another aspect of the present invention, a method for minimizing resistance to aspirated fluid flow in a liquid pump is provided. The liquid pump is similar to that described above and the method includes the steps of forming a flat surface on the piston parallel with the piston centerline at a distal end of the piston, wherein the flat surface is formed at a distance from the centerline of the piston greater than or equal to ½ of the diameter of the transverse inlet bore of the liner. The flat surface defines a cut-out portion of the piston having a hydraulic diameter Dh defined as Dh=4 A/P, where A is a cross-sectional area of the cut-out portion and P is the perimeter of the cut-out portion. The method further includes forming a diameter of the inlet bore in the liner equal to the hydraulic diameter of the cut-out portion.

The new design optimizes the relationship between the liner port diameters and the depth of the piston flat to help reduce the pressure changes inside of a positive displacement pump and to help reduce pump cavitation under certain conditions.

The preferred embodiments of the apparatus and method of the present invention, as well as other objects, features and advantages of this invention will be apparent from the following detailed description, which is to be read in conjunction with the accompanying drawings.

DETAILED DESCRIPTION OF THE PREFERRED EMBODIMENTS

Figure 1:
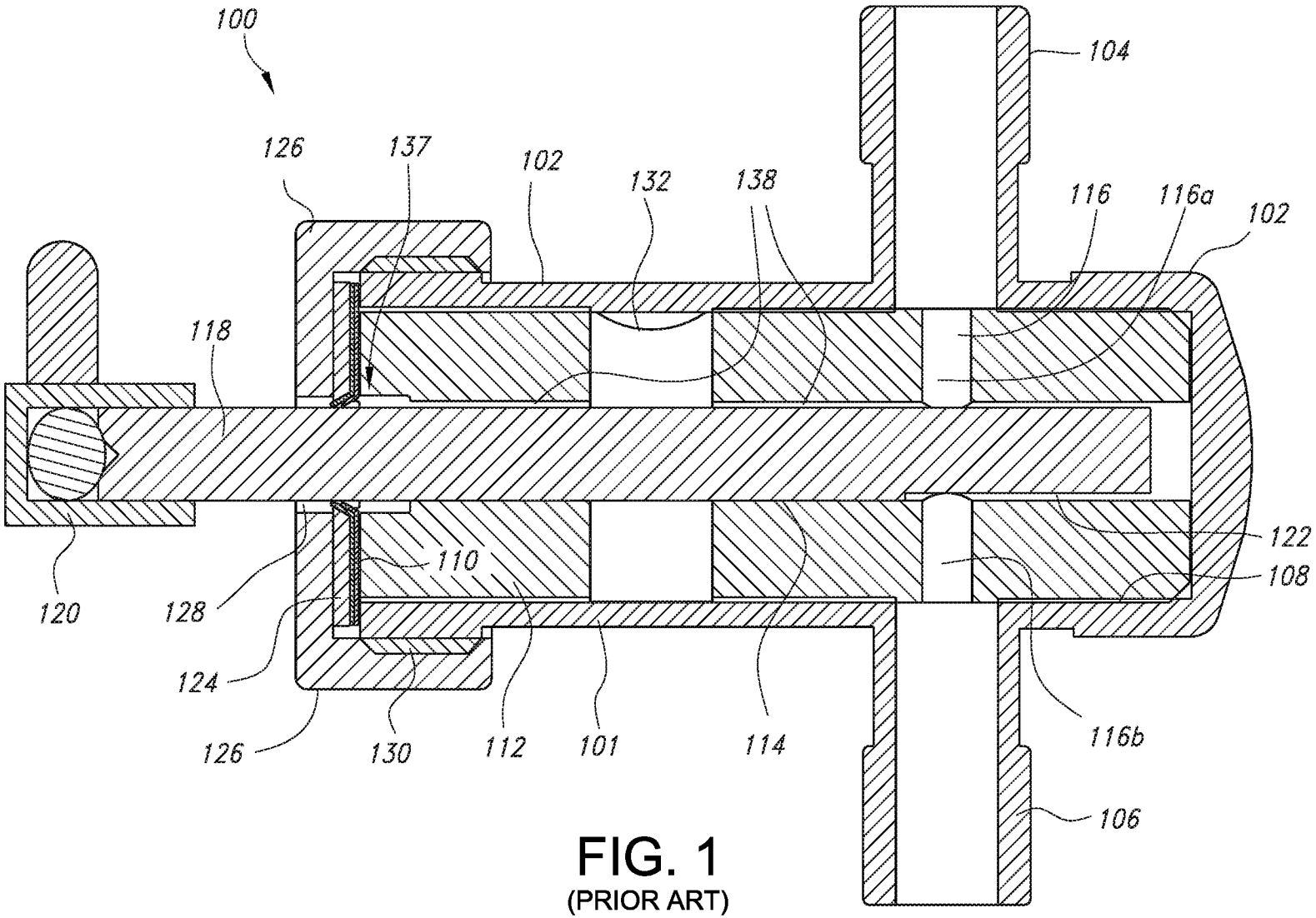
FIG. 1 (PRIOR ART)
FIG. 1 is a cross-sectional view of a liquid pump of the prior art.

Referring first to FIG. 1, a liquid pump 100 of the prior art is shown in cross-section. The pump 100 generally includes a pump housing 101 and a piston 118. The pump housing 101 preferably includes a plastic pump casing 102 having an inlet port 104 and an outlet port 106. The pump casing 102 defines a cylindrical chamber 108 having an open end 110. Received in the cylindrical chamber 108 is a ceramic piston liner 112 having a central longitudinal bore 114 and a transverse bore 116 communicating with the longitudinal bore. The transverse bore 116 includes a liner inlet port 116*a* fluidly communicating with the inlet port 104 of the pump casing 102 and a liner outlet port 116*b* fluidly communicating with the outlet port 106 of the pump casing so that a liquid can be pumped from the inlet port, through the liner, to the outlet port in a manner as will be described below.

The pump 100 further includes a ceramic piston 118 axially and rotatably slidable within the central bore 114 of the piston liner 112. One end of the piston 118 extends out of the open end 110 of the pump casing 102 and includes a coupling 120 for engagement with a motor. At its opposite end, the piston 118 is formed with a relieved or "cutout" portion 122 disposed adjacent the transverse bore 116 of the pump liner. As will be described below, the relieved portion 122 is designed to direct fluid into and out of the pump 100.

A seal assembly 124 is provided at the open end 110 of the pump casing 102 to seal the piston 118 and the pump chamber 108. The seal assembly 124 is retained at the open end 110 of the pump casing 102 by a gland nut 126 having a central opening 128 to receive the piston 118. The gland nut 126 is preferably attached to the pump casing 102 with a threaded connection 130 provided therebetween.

In operation, a motor (not shown) drives the piston 118 to axially translate and rotate within the central bore 114 of the piston liner 112. In order to draw liquid into the transverse bore 116 from the inlet port 104, the piston 118 is rotated as required to align the relieved portion 122 with the liner inlet port 116*a*. The piston 118 is then drawn back as required to take in the desired volume of liquid into the central bore 114 of the pump liner 112. Withdrawal of the piston 118 produces a negative pressure within the liner inlet port 116*a* of the transverse bore 116, which draws in liquid from the casing inlet port 104. The piston 118 is then rotated to align the relieved portion 122 with the liner outlet port 116*b*. Finally, the piston 118 is driven forward the required distance to force liquid into the outlet port 116*b* of the transverse bore 116 to produce the desired discharge flow.

Figure 2A:
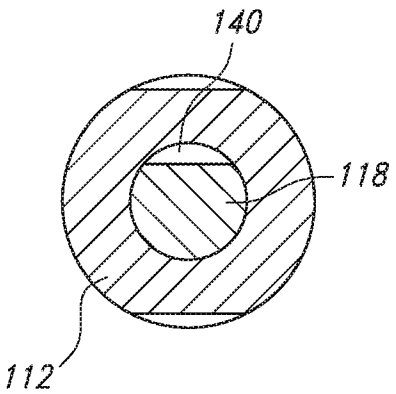
FIG. 2A (PRIOR ART)
FIG. 2*a* is a cross-sectional view of the pump piston and liner shown in FIG. 2 taken along the line 2*a*-2*a*.
Figure 2:
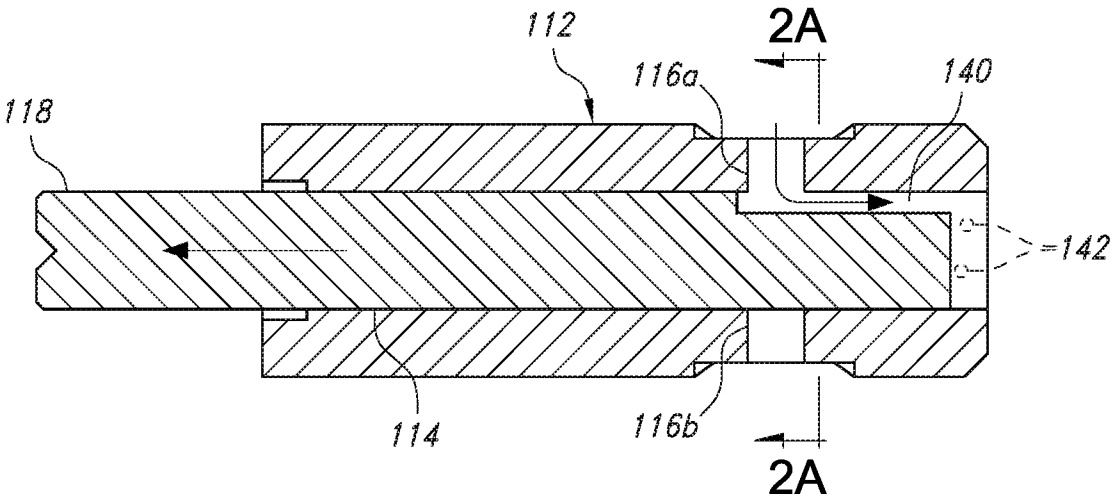
FIG. 2 (PRIOR ART)
FIG. 2 is a detailed view of the prior art pump piston and liner shown in FIG. 1.

Referring additionally to FIGS. 2 and 2*a*, the fundamental limiting condition within the pumps of the prior art is associated with cavitation. When the pump attempts to aspirate fluid into its intake port 116*a*, the only mechanism available to accelerate the fluid into the expanding cavity 140 within the pump, created by the retracting piston 118, is pressure outside the pump. Most often the actuating pressure is that of the surrounding atmosphere, which is roughly 15 psi at sea level. If the pressure anywhere inside the pump drops below the available "pushing" inlet pressure, fluid will not be available to fill the expanding cavity 140 created by the retracting piston 118. Such a condition will create unfilled voids 142 within the fluid. Those unfilled voids 142 subtract volume from the slug of aspirated fluid. When the piston 118 reverses its axial movement, the voids 142 collapse, causing cavitation, and a reduced volume of fluid is available for discharge from the pump.

FIGS. 2 and 2*a* show a typical pump of the prior art employing, for example, a ⅜" (0.375) piston 118 and an inlet port 116*a* having a diameter of 7/32". This ⅜" piston/liner set was designed following the single consideration idea of using convenient fractional tooling to create the port hole and then dimensioning the flat depth so as to avoid blow-by.

The novelty of the present invention is to introduce a second consideration in selection of the piston flat depth and liner port diameter beyond merely choosing a convenient port size and matching piston flat to avoid blow-by. That second consideration was associated with aspects limiting maximum flow possible through any given pump size.

Figure 3A:
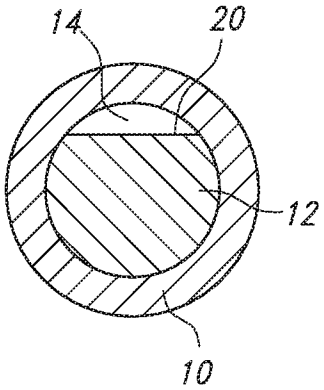
FIG. 3*a* is a cross-sectional view of the pump piston and liner shown in FIG. 3 taken along the line 3*a*-3*a*.
Figure 3:
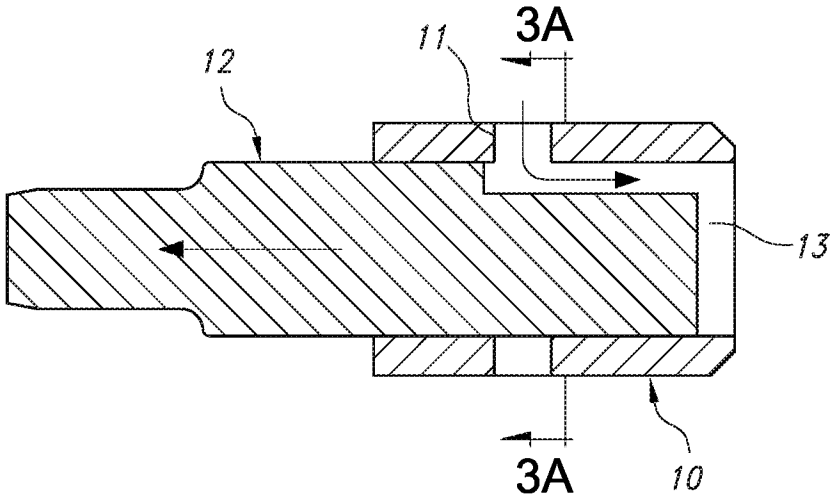
FIG. 3 is a schematic layout of a pump piston and liner formed in accordance with the present invention.

FIGS. 3 and 3*a* show a pump set, including a liner 10 and a reciprocating piston 12, according to the present invention. The ceramic piston 12 has, for example, a 9 mm (0.354") diameter, which was designed with the double consideration concept described herein. As described above, the piston 12 is formed with a flat 20, which defines a D-shaped relieved portion 14, and which further defines a channel within the liner 10 through which fluid flows. Comparing the "D" channel section 140 of the pump according to the prior art shown in FIG. 2*a* with the "D" channel section 14 of the pump according to the present invention clearly shows that, in spite of being a smaller set, the 9 mm piston/liner actually has a larger "D" channel available for fluid flow than the legacy ⅜".

The lack of a double consideration coordination design of port diameter and piston flat depth in the legacy ⅜" ceramic set yields a "D" shaped channel 140 with approximately 4× the flow resistance of the liner port 116*a*. By contrast, the flow resistances of port hole 11 and "D" shaped channel 14 in the 9 mm piston/liner set are approximately equal. Accordingly, the resistance to fluid flow through the liner port 116*a* and down the "D" shaped channel 140 is considerably higher for the legacy ⅜" design than it could have been if the teachings of this invention had been used. The same opportunity for reduced flow resistance and improved high flow performance found with the ⅜" pump has been found to apply to all other legacy pumps listed in Table A.

Figure 4:
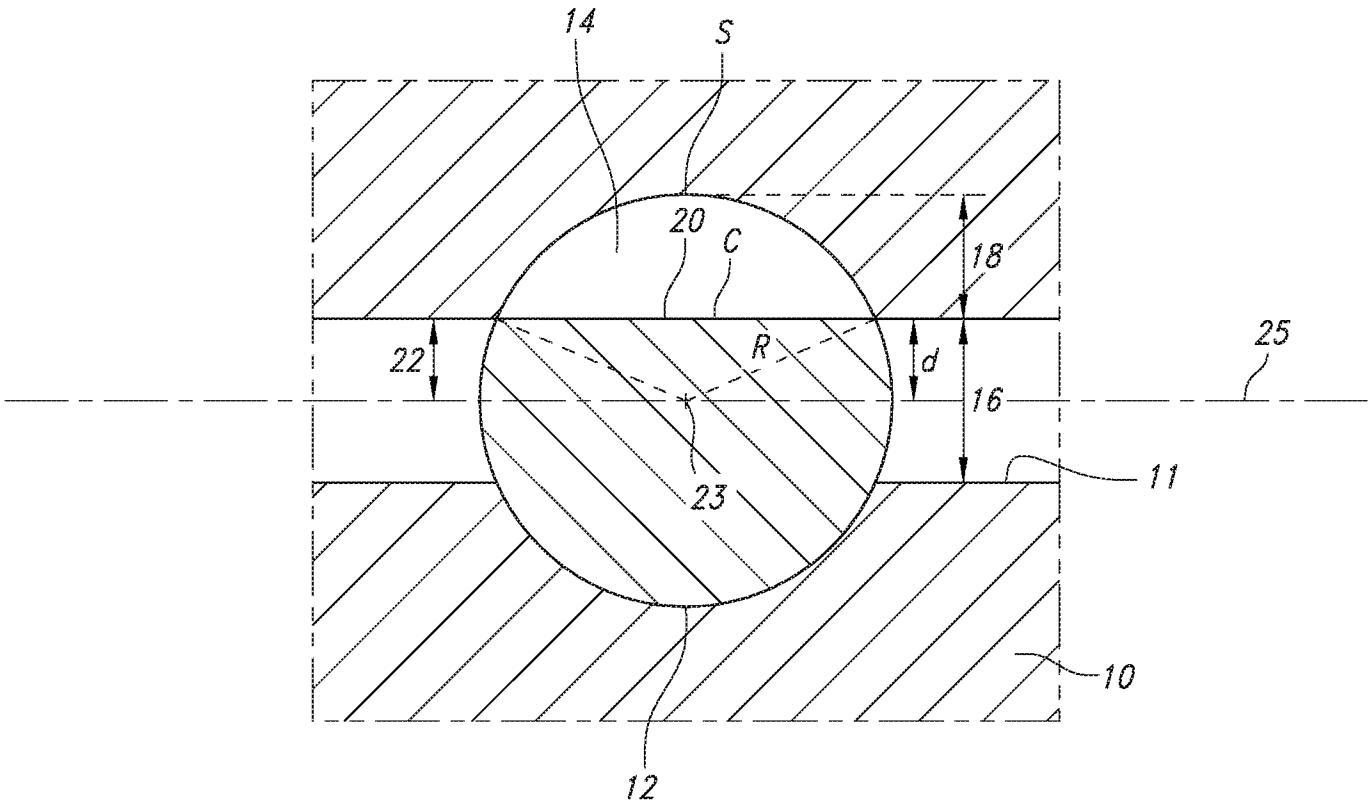
FIG. 4 is a schematic layout showing the piston end and the position of the ports illustrating the present invention.

Referring additionally to FIG. 4, the pump of the present invention is formed as follows. The liner 10 is formed with a liner port 11 having a circular cross-section, while the piston 12 has a cut-out portion 14 with an irregular shape for its cross section, (i.e., a "D" shape). In an aspect of the present invention, the port diameter 16 and the depth 18 of the cut of the cut-out portion 14, as measured from the circumferential outer surface of the piston 12 are coordinated using the concept of a hydraulic diameter.

Hydraulic diameter is used to calculate pressure loss in ducts or pipes when the flow is characterized as turbulent. The high fluid velocities associated with pumps approaching their maximum output flow are definitely turbulent and well beyond laminar. Accordingly, pressure loss calculations appropriately apply hydraulic diameter to such flows within the pump body.

As fluid enters the pump, it first passes through the port 11 and then proceeds along the "D" shaped channel 14 towards the cavity 13 being expanded at the bottom of the piston 12. Reducing pressure drop along the fluid path will promote good filling of the pump during aspiration. An obvious way to reduce flow resistance through the circular port is to increase the diameter 16 of the port 11. However, as explained above, an increase in port diameter must be accompanied by a reduction in depth of the piston flat in order to avoid "blow-by". This will lead to an increase in pressure drop along the "D" shaped channel and thereby defeat the objective of reducing overall resistance to fluid flow.

It is deemed desirable that pressure drop or resistance to flow be minimized for the full path of fluid travel. In order to coordinate liner port diameter 16 with the "D" shaped channel 14, the object is to match flow resistance for the portion of the flow path through the port 11 and the portion of the flow path along the "D" shaped channel while minimizing overall resistance. Calculation of pressure drop along the fluid path utilizes hydraulic diameter and it can be shown that different channel shapes (e.g., circular or "D" shaped) will have the same turbulent flow pressure drop if they have the same hydraulic diameter.

The equation that defines the hydraulic diameter is:

$$Dh = 4\frac{A}{P}$$

where Dh is the hydraulic diameter, A is the cross sectional area of the cut-out portion 14, and P is the perimeter of the cut-out portion 14. Thus, it can readily be seen that the hydraulic diameter of a circular cross section is equal to the diameter itself. The goal is to calculate the hydraulic diameter for the irregular shaped "D" cross-section 14 and have it equal the diameter 16 of the liner port 10, while avoiding the blow-by condition.

In pumps of this type, the piston 12 has an axial center line 23 that intersects with an axial centerline 25 of the liner port 11. To avoid the blow-by condition, the distance d from the center 25 of the piston 12 to the piston flat 20, must be greater than or equal to the port radius 22 (½ the diameter 16 of the port 11). To solve for that minimum distance d, the equation Dp=2d is used where Dp is the port diameter 16. Both equations come together where the hydraulic diameter equals the port diameter:

$$2d = 4\frac{A}{P}$$

The area of the cut-out portion 14 can be expressed as:

$$A = \tfrac{1}{2}(Rs - cd)$$

Where R is the piston radius, s is the arc length of the cut off portion of the piston, and c is the piston flat length viewed from the piston end. The perimeter of the cut-out portion 14 can be expressed as:

$$P = c + s$$

The equations can be solved in terms of d, which is the minimum distance for the piston center to flat to prevent the blow-by condition. Solving for Dp with this value gives the maximum port diameter. These values can then be used as a reference to determine the port diameter and depth of the "D" cut on the piston while taking into account the manufacturing tolerances.

Figure 5:
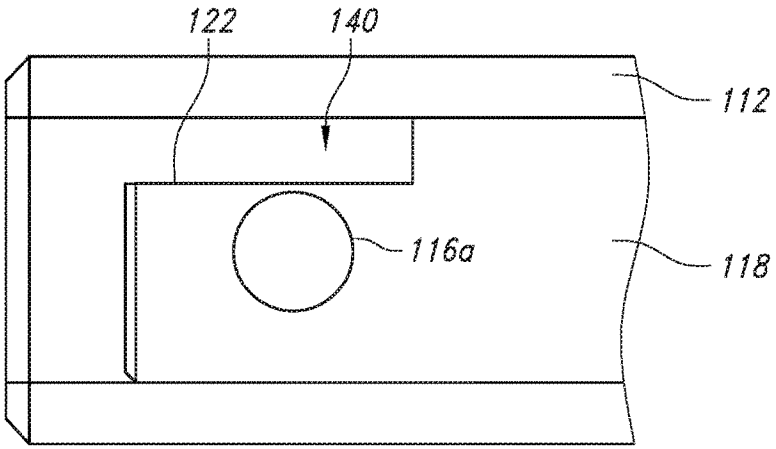
FIG. 5 (PRIOR ART)
FIG. 5 schematically shows a piston/liner that is not optimized.
Figure 6:
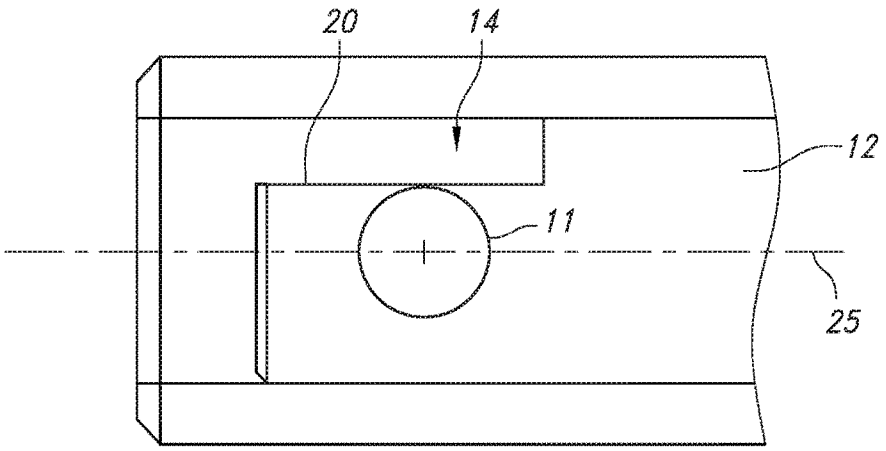
FIG. 6 schematically shows a piston/liner that is optimized according to the present invention.

FIG. 5 shows a piston 118 and liner 112 of the prior art that has not been optimized, as compared to a piston 12 and liner 10 of the present invention shown in FIG. 6. As can be seen in FIG. 6, the hydraulic diameter of the piston cut-out portion 14 of the present invention is equal to the diameter of the liner inlet port 11. Also, the distance from the center 25 of the piston 12 to the flat surface 20 of the cut-out portion 14 is slightly greater than the radius (½ of the diameter) of the inlet port 11 to avoid a blow-by condition.

Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

What is claimed is:

1. A liquid pump comprising:

a pump liner defining a central longitudinal bore and a transverse inlet bore communicating with said central bore for conveying a liquid through said pump liner, said transverse inlet bore having a diameter centered around a centerline intersecting with a centerline of the central longitudinal bore; and a pump piston axially and rotatably slidable within said central longitudinal bore for pumping the liquid from said transverse inlet bore, said pump piston having a centerline intersecting with the centerline of the transverse inlet bore, and further having a flat surface formed parallel with said piston centerline at a distal end of the piston, said flat surface defining a cut-out portion of the piston, said cut-out portion having a hydraulic diameter Dh defined as Dh=4 A/P, where A is a cross-sectional area of the cut-out portion and P is the perimeter of the cut-out portion, and wherein the hydraulic diameter of the cut-out portion is equal to the diameter of the transverse inlet bore of the liner, and wherein a distance from the centerline of the piston to the flat surface defining the cut-out portion is greater than or equal to ½ of the diameter of the transverse inlet bore of the liner.

2. The liquid pump as defined in claim 1, wherein said pump liner further includes a transverse outlet bore, said cut-out portion of said piston rotationally reciprocating between said inlet bore and said outlet bore.

3. The liquid pump as defined in claim 1, wherein said cut-out portion has a D-shaped cross-section.

4. The liquid pump as defined in claim 1, wherein the cut-out portion of the piston presents a flow resistance equal to a flow resistance presented by the inlet bore.

5. A method for minimizing resistance to aspirated fluid flow in a liquid pump, the liquid pump comprising:

a pump liner defining a central longitudinal bore and a transverse inlet bore communicating with said central bore for conveying a liquid through said pump housing, said transverse inlet bore having a diameter centered around a centerline intersecting with a centerline of the central longitudinal bore; and a pump piston axially and rotatably slidable within said central longitudinal bore for pumping the liquid from said transverse inlet bore, said pump piston having a centerline intersecting with the centerline of the transverse inlet bore, the method comprising:

forming a flat surface on the piston parallel with said piston centerline at a distal end of the piston, the flat surface being formed at a distance from the centerline of the piston greater than or equal to ½ of the diameter of the transverse inlet bore of the liner, said flat surface defining a cut-out portion of the piston, said cut-out portion having a hydraulic diameter Dh defined as Dh=4 A/P, where A is a cross-sectional area of the cut-out portion and P is the perimeter of the cut-out portion; and forming a diameter of the inlet bore in the liner equal to the hydraulic diameter of the cut-out portion.

6. The method as defined in claim 5, wherein said pump liner further includes a transverse outlet bore, said cut-out portion of said piston rotationally reciprocating between said inlet bore and said outlet bore.

7. The method as defined in claim 5, wherein said cut-out portion has a D-shaped cross-section.

8. The method as defined in claim 5, wherein the cut-out portion of the piston presents a flow resistance equal to a flow resistance presented by the inlet bore.

* * * * *